United States Patent [19]

Sagel et al.

[11] 3,971,815

[45] July 27, 1976

[54] ACID MIX PROCESS

[75] Inventors: John A. Sagel, Mount Healthy, Ohio; Clarence Edward Weber, Cold Spring, Ky.

[73] Assignee: The Procter & Gamble Company, Cincinnati, Ohio

[22] Filed: Nov. 13, 1974

[21] Appl. No.: 523,390

[52] U.S. Cl. ..... 260/400; 260/458; 260/459 R; 260/460; 260/481 R; 260/505 S; 260/513 R; 260/513 T; 252/550

[51] Int. Cl.[2] ..... C11D 1/12; C11D 1/28

[58] Field of Search ..... 260/400, 505 S, 513 R, 260/513 T, 458 R, 460, 459 R, 481 R

[56] References Cited

UNITED STATES PATENTS

| | | | |
|---|---|---|---|
| 2,061,620 | 11/1936 | Downing et al. | 260/513 T |
| 2,771,484 | 11/1956 | Blaser et al. | 260/400 X |
| 3,151,153 | 9/1964 | Keith et al. | 260/507 R |
| 3,211,659 | 10/1965 | Pikaar | 252/136 |
| 3,251,868 | 5/1966 | Stein et al. | 260/400 |
| 3,259,645 | 7/1966 | Brooks et al. | 260/459 R |
| 3,350,428 | 10/1967 | Brooks et al. | 260/400 |
| 3,446,743 | 5/1969 | Marquis | 252/161 |
| 3,915,903 | 10/1975 | Wise | 252/552 |

*Primary Examiner*—Patrick P. Garvin
*Attorney, Agent, or Firm*—Forrest L. Collins; Charles R. Wilson; Richard C. Witte

[57] ABSTRACT

Low viscosity detergent acid mixes are prepared by reacting an ethoxylated alcohol, alkyl benzene, fatty alcohol, or other sulfatable detergent precursor with a sulfating agent in the presence of benzoic acid. Benzoic acid does not sulfonate under the conditions of the improved process.

15 Claims, No Drawings

ACID MIX PROCESS

BACKGROUND OF THE INVENTION

The present invention relates to the preparation of detergent acid mix compositions containing benzoic acid. The benzoic acid substantially reduces the viscosity of the acid mix formed in the reaction of an ethoxylated alcohol, alkyl benzene, fatty alcohol, or other sulfatable detergent precursor with the sulfating agent. The use of the term "sulfating agent" throughout the specification and claims includes, but is not limited to, oleum, 100% sulfuric acid, chlorosulfonic acid, and sulfur trioxide. The use throughout this application of the term "viscosity aid" is defined to mean a material which will reduce the viscosity of a detergent acid mix comprising the organic sulfuric or sulfonic acid as well as sulfating agent or unreacted detergent precursor present. For the purposes of this application, the term "sulfation", unless otherwise indicated, may be used interchangeably with "sulfonation".

The strength of the sulfating agent may be expressed in many forms. The apparent acid strength is expressed as the percentage of sulfuric acid which would be formed if sufficient water were present to convert all the sulfur trioxide to sulfuric acid. The term "acid strength" relates to the concentration of sulfur trioxide in oleum. If the sulfating agent is sulfuric acid, the acid concentration must be 100% as sulfuric acid is not a particularly effective sulfating agent. Spent acid strength is a measure of the final concentration of the sulfating agent remaining after the sulfation reaction. A critical spent acid strength exists for most detergent precursors below which the sulfation reaction will not proceed effectively. The percentage of spent acid strength is given by the following formula:

$$\% \text{ spent acid strength} = \frac{100 \text{ (moles excess } SO_3) \times \text{mol. wt. } H_2SO_4}{(\text{moles excess } SO_3) \times \text{mol. wt. } SO_3 + (H_2O)}$$

where (excess $SO_3$) is the sulfur trioxide introduced to the reaction over and above that used in the sulfation. The excess sulfur trioxide is subsequently neutralized to form sodium sulfate. The quantity ($H_2O$) is the water introduced into the system during the sulfation process. The percentage spent acid strength is a measure of the available sulfur trioxide which may be used for sulfation. In other words, where the sulfur trioxide would react on a one-to-one mole basis with the detergent precursor to give a sulfated product, the addition of water to the system will lower the amount of sulfur trioxide available for sulfation of the detergent precursor.

Toluene, xylene, cumene, and benzene are sulfatable materials known in the art as having utility in their sulfonated form in reducing acid mix viscosity. Toluene is the most widely used material for reducing the viscosity of detergent acid mix compositions and is exemplary of the other sulfatable viscosity aids. The use of toluene as well as the other sulfatable viscosity aids is not without substantial drawbacks. One such drawback in the use of toluene as a viscosity aid arises because toluene is very reactive in the presence of sulfating agents. Thus, when toluene is sulfonated in the presence of a less reactive organic compound, the toluene is preferentially sulfonated to toluene sulfonic acid.

Toluene as a viscosity aid at high acid strengths is undesirable in that the toluene sulfonic acid may continue to react with the sulfating agent to form disulfonic acids in the ortha and meta positions, thus using more sulfating agent than is required with unpredictable results. If toluene is sulfonated in the presence of a more reactive organic compound, the completeness of toluene sulfonation will be lessened with potential side reactions of the detergent precursor occurring. Incomplete sulfonation of an aromatic sulfonatable viscosity aid will result in the aromatic compound being processed through the crutcher with evaporation from the crutcher mix, or, if the product is spray-dried, a "plume" may be emitted from the drying towers.

Thus the sulfonation of toluene requires in many cases that the toluene be sulfonated in the absence of the detergent precursor, therefore requiring additional equipment if the process is to be continuous.

The preparation of detergent compositions ordinarily requires that the acid mix be neutralized. As toluene may form a mono- or di-sulfonic acid when sulfonated, it is apparent that at least one mole of caustic will be required to neutralize each mole of sulfonate to be formed. The previously mentioned neutralization steps are costly in the use of excessive amounts of base. The exothermic sulfonation of toluene and subsequent neutralization of toluene sulfonic acid impose an additional heat exchange load on the system. Thus the use of a non-sulfatable viscosity aid will reduce heat transfer requirements while using less caustic. As some sulfuric acid is usually present in all sulfation reactions, sodium sulfate will be present in the final product from neutralization. By using a non-sulfatable viscosity aid, the amount of sulfating agent used is reduced and thus less sodium sulfate is formed leaving more room in the formula. The foregoing advantages are equally applicable to the replacement of benzene, cumene, and xylene by a non-sulfatable viscosity aid.

Aromatic sulfonate salts such as toluene sulfonate have been used as anti-caking agents in spray-dried phosphate-containing granular detergent compositions. However, when phosphate builders are eliminated from spray-dried detergent compositions, the presence of aromatic sulfonates may aggravate the caking tendencies of the detergent product. The viscosity aid of the present invention is also a novel anti-caking aid for use with non-phosphate built granular detergent products. Benzoate salts as anti-caking aids are discussed in the commonly assigned and concurrently filed U.S. Pat. application of J. A. Sagel and C. E. Weber having Ser. No. 523,391 and a filing date of Nov. 13, 1974 now U.S. Pat. No. 3,932,316 and further discussed in the commonly assigned and concurrently filed U.S. Pat. application of J. A. Sagel and C. E. Weber having Ser. No. 523,392 and a filing date of Nov. 13, 1974, both incorporated herein by reference.

Accordingly, it is an object of the present invention to provide a process for reducing the viscosity of a detergent acid mix composition.

It is a further object of the present invention to eliminate or substantially reduce the amount of toluene sulfonate used in the processing of non-phosphate granular detergents.

It is a further object of the present invention to provide a viscosity aid which does not sulfonate in the process of preparing an organic sulfuric or sulfonic acid mix composition.

It is a particular object of the present invention to provide a process in which a non-sulfatable viscosity aid substantially lowers the viscosity of an alkyl ether sulfuric acid in an acid mix.

It has been discovered that during the sulfation of detergent precursors such as an alkyl benzene, fatty alcohol, or an ethoxylated alcohol, with oleum, sulfuric acid, chlorosulfonic acid, or sulfur trioxide that the viscosity of the resultant composition can be substantially reduced by carrying out the sulfation process in the presence of benzoic acid. The benzoic acid when used in the instant sulfation process remains essentially unreacted.

Percentages and ratios given throughout the application are by weight unless otherwise indicated. The use of the term "alkyl" means branched as well as straight-chained material. Temperatures are in Fahrenheit unless indicated otherwise.

SUMMARY OF THE INVENTION

The instant invention relates to a process for preparing a low viscosity detergent acid mix. The invention, therefore, comprises the process of contacting a sulfatable organic detergent precursor with a sulfating agent, the improvement thereon comprising carrying out the reaction in the presence of an effective amount of benzoic acid to lower the acid mix viscosity.

DETAILED DESCRIPTION OF THE INVENTION

The improved process of this invention may be varied according to the particular apparatus used and the type of acid mix composition desired to be formed. The variations in the process and the composition are discussed in detail as follows:

The Sulfation System

Sulfation or sulfonation of various organic components are done on a continuous process such as in a dominant bath system or on a single batch basis. The first system to be discussed is the single batch process.

A. Batch System

The batch process is an operation comprising adding the sulfating agent and the organic sulfatable detergent precursor which is to be sulfated or sulfonated into a vat. The initial reaction in the batch process proceeds rapidly to completeness because of the high concentration of the reactants. However, the final concentration of the sulfated organic product in the acid mix will be lower because of the poor mixing encountered in the batch process. The yield in a batch process can, however, be increased by thoroughly mixing the system by any conventional means.

The mixing of the reactants can be greatly improved by the addition to the reaction vessel of a material which will reduce the viscosity of the composition.

The viscosity aid of the present invention, benzoic acid, is advantageously added to a batch system by dissolution in the organic materials to be sulfated, e.g., ethoxylated alcohols, fatty alcohols, and alkyl benzenes. The sulfatable detergent precursors are used alone or in combination with one another. Of particular interest is the discovery that the ethoxylated alcohols may be sulfated in the batch or in the later discussed dominant bath process in the presence of only the sulfating agent and benzoic acid. Heretofore it was not thought possible to sulfate an ethoxylated alcohol unless another material was present to be cosulfated with the ethoxylated alcohol. Materials which were used in the cosulfation process with the ethoxylated alcohol were generally alkyl benzenes, toluene or fatty alcohols. As a consequence of the applicants' discovery that ethoxylated alcohols do not require a cosulfatable material, it is now possible to formulate acid mix compositions comprising an alkyl ether sulfuric acid and benzoic acid.

The product obtained from the batch process comprises the viscosity aid and the sulfated reaction product as well as any excess sulfating agent and unreacted detergent precursor. The resultant acid mix described above is then further processed to remove the excess sulfating agent, or the acid mix may be neutralized with the excess sulfating agent present. It will be recognized that if the acid mix does not have the excess sulfating agent removed from it prior to neutralization, that a quantity of sodium sulfate will be formed. The acid mix is most often neutralized with sodium hydroxide and is then referred to as a paste. The paste is further processed by conventional methods to give as a final product a granular detergent composition.

B. Dominant Bath

The dominant bath is the most commonly used oleum or sulfuric acid sulfation process. The dominant bath provides for a continuous production of an acid mix. In contrast to the batch process, the dominant bath allows the preparation of an acid mix under much more controlled reaction conditions.

In the dominant bath process the reactants are injected into a recirculating stream of reaction products. The heat of reaction which is considerable in a sulfation or sulfonation process is thus dissipated into the recirculating acid mix which facilitates heat removal and mixing. In an ideal dominant bath the reactants are completely distributed throughout the system such that all parts of the bath have an identical composition with the mean reaction time equal to the volume of the system divided by the effluent flow rate. In this context effluent is defined as the acid mix which is removed from the system to be further processed, such as paste formation. In the dominant bath system the recirculation ratio will determine the degree of approach to the ideal system. The recirculation ratio is defined as being the volume of recirculated material divided by the volume of the effluent. Typical recirculation rates which will vary according to the material to be sulfated are from 20:1 to 40:1 with an average of 25:1. Thus, a recirculation ratio of 25:1 indicates that for every part of effluent, 25 parts of acid mix are recirculated through the system. The recirculation ratio also indicates the maximum amount of new reactants which may enter the system; thus the rate at which the effluent leaves the system is equal to the rate at which the new reactants enter the system.

In contrast to a batch system where the reaction is initially fast as the reactants are high in concentration with the rate decreasing as the reactants are consumed the dominant bath provides a system where the reactants are at their final concentration and hence the reaction is relatively slower. The longer reaction time for completion of the sulfation reaction is the most notable disadvantage of the dominant bath system. The foregoing disadvantage however is greatly outweighed by the heat removal capacity in the dominant bath resulting in less charred material.

To avoid using a dominant bath with an unduly large volume or greatly increasing the recirculation ratio, it has been suggested to remove the effluent acid mix from the system before the sulfation reaction has been completed. The effluent which has been substantially reacted is then passed through a coil of sufficient length to allow the sulfation reaction to continue to completion despite the absence of mixing. The use of the coil is possible because the effluent has been substantially reacted in the dominant bath, thus requiring little or no heat transfer in the reaction coil. The length of the coil and the recirculation ratio can thus be varied so that the various sulfatable materials can achieve maximum completeness of the reaction with the shortest period of time in the dominant bath and in the coil.

The reaction by the preceding steps is thus controlled to neutralize the acid mix at the proper time to avoid secondary reactions which are undesired. The temperature in the dominant bath should be maintained in a range of 85°–150°F, preferably 95°–130°F, depending on the desired degree of completion of the reaction, the acceptable amount of charring and minimization of secondary reactions.

The low melting point of tallow alcohol can present problems in heat transfer during sulfation. The tendency to coat the heat exchanger surfaces is much greater if a large proportion of unreacted tallow alcohol is present in the acid mix. Thus the heat exchanger capacity is limited in that the coolant should not be used at a temperature which would allow the unreacted tallow alcohol in the acid mix to coat the heat exchanger surfaces. However, in the instant invention, the lowering of the viscosity promotes mixing, thus less unreacted tallow alcohol is available to interfere with the heat exchanger.

The sulfatable compounds are preferably premixed with the viscosity aid and introduced at a point of high shear into the dominant bath system.

If two components are to be sulfated which require different spent acid strengths for completeness and quality, series sulfation may be employed. Series sulfation is a system in which one component is first sulfated as has been previously discussed, and then that acid mix is used as a diluent for the sulfation of a second material. A common practice is to sulfonate an alkyl benzene first and then combine the acid mix with a fatty alcohol or an ethoxylated alcohol prior to sulfating the latter materials. It is stressed that in the instant invention it is possible to avoid series sulfation or cosulfation when sulfating an ethoxylated alcohol. Prior to the applicants' invention, it was not practicably possible to directly sulfate an ethoxylated alcohol with oleum or sulfuric acid.

C. Film Sulfonation

Many detergent precursors can be sulfated by using film sulfation methods. Basically the process in a film reactor comprises introducing the detergent precursor at the top of a reaction vessel such that a thin film is formed on the walls of the vessel. The film is continuously exposed to a gaseous sulfating agent as the film moves along the surface of the reaction vessel. The sulfating agent may be sulfur trioxide or sulfur trioxide diluted with a gas which is inert in the process such as sulfur dioxide.

The viscosity aid is preferably added to the detergent precursor prior to the film forming step. The viscosity aid will function to lower the viscosity of the acid mix formed. Examples of suitable detergent precursors which may be sulfated in the film process are ethoxylated alcohols, α-olefins and aliphatic carboxylic acids. Further film reactor techniques are described in U.S. Pat. Nos. 3,346,505; 3,309,392; 3,531,518 and 3,535,339 herein incorporated by reference.

D. Sulfating Agent

As was previously stated in this application the term "sulfating agent" is to be used in its generic sense indicating a material which is capable of sulfating or sulfonating another compound. The sulfating agents which the instant application incorporates are sulfuric acid, oleum, chlorosulfonic acid and sulfur trioxide. The practical use of sulfuric acid as a sulfating agent is limited to those situations where 100% sulfuric acid is used, as the spent acid strength of sulfuric acid is otherwise too low to ensure sulfation of the detergent precursor. Chlorosulfonic acid is normally employed in a batch reaction while sulfur trioxide diluted with an inert gas is employed in a film reactor.

Oleum, which is a mixture of sulfuric acid and sulfur trioxide, is the preferred sulfating agent in the present invention when the sulfation is carried out in a batch process or in a dominant bath system. The acid strength of the oleum used may be as high as 65%; however, the preferred range of oleum acid strengths is between 10% and 40%. The choice of the oleum strength used is dependent upon such factors as the desired degree of completeness of sulfation in the dominant bath, the limitations on heat exchanger capacity wherein higher concentrations of oleum result in substantially higher reaction temperatures, the degree of charring which can be tolerated and the choice of the material to be sulfated.

E. The Sulfatable Compound

The particular materials of interest in the instant invention are alkyl benzenes, fatty alcohols and ethoxylated alcohols, although other detergent precursors are utilized in the instant invention such as α-olefins, fatty acids, and fatty acid esters or other sulfatable organic compounds.

An alkyl benzene which may include some branched chain material in the alkyl group will preferentially sulfonate with sulfuric acid or oleum in the para position with minor amounts of sulfonation at other positions on the benzene ring. The sulfonation of an alkyl benzene is a non-reversible reaction; however, the presence of water in the system may reduce the spent acid strength to a point at which the sulfonation reaction does not proceed. Below a spent acid strength of about 90% the sulfonation reaction will not proceed while at spent acid concentrations above 100%, secondary reactions which affect the color of the neutralized paste and odor become troublesome. Spent acid concentrations may be from 95% to 103%, preferably in the 98.5–101% range for the best completeness of an alkyl benzene sulfonation with acceptable charring. The secondary reactions which are alluded to above can include oxidation, dehydration, and rearrangement of the alkyl radical of the alkyl benzene. The apparent acid strength of the oleum used with an alkyl benzene should be from about 100% to about 122.5%, preferably about 102% to about 122.5%. The sulfonation of an alkyl benzene is preferably carried out in a dominant bath with a temperature maintained between 85°F and 150°F, preferably from 110°F to 130°F, with a recirculation ratio of greater than 15:1 and preferably greater than 25:1. The weight ratio of alkyl benzene to sulfating agent is from about 1:8 to 7:1, preferably about 1:4 to 10:3. Alkyl chains on an alkyl benzene have from about 9 to 15 carbon atoms, preferably between 11 and 12 carbon atoms.

The sulfation reaction of a fatty alcohol proceeds rapidly but is reversible in the presence of water. Fatty alcohols while undergoing sulfation are also prone to side reactions resulting in the formation of alkenes, ethers, esters and aldehydes. A high spent acid strength minimizes the reversible hydrolysis but increases the dehydration and oxidation reactions noted above.

The temperature range at which sulfation of an alcohol is best accomplished in a dominant bath system is between 85°F and 150°F and preferably from 100°F to 125°F with a recirculation ratio of greater than 15:1 and preferably greater than 25:1. The apparent acid strength used in sulfating a fatty alcohol should be from about 100% to about 122.5%, preferably about 102% to about 122.5%. The spent acid strength is preferably maintained in the range of from about 90% to about 103% and preferably from about 95% to about 101%. The weight ratio of sulfating agent to fatty alcohol is from about 3:1 to about 1:4, preferably about 2:1 to about 1:2. Preferably the fatty alcohol contains from about 8 to 24 carbon atoms with especially useful materials being of the tallow length.

The sulfation of an ethoxylated alcohol by oleum or sulfuric acid in either a batch or a dominant bath process has, until the present invention, required a sulfatable viscosity aid or dilutation of the acid mix by cosulfonation or series sulfonation with a second detergent precursor to avoid severe charring of the ethoxylated alcohol. In the instant invention the sulfation of an ethoxylated alcohol may be carried out with only the benzoic acid viscosity aid and the sulfating agent present. The apparent acid strength used in sulfating an ethoxylated alcohol should be from 100% to about 122.5%, preferably about 102% to about 122.5%. The sulfation of the ethoxylated alcohol may take place between about 85°F and about 150°F and preferably from about 105°F to about 130°F. The percentage of spent acid strength resulting from the preparation of an alkyl ether sulfuric acid should be maintained between about 90% and about 103% and preferably from about 95% to about 101% with a recirculation ratio of greater than 15:1, preferably greater than 25:1. The weight ratio of sulfating agent to ethoxylated alcohol is from about 7:1 to about 1:10, preferably about 3:1 to about 1:3.

The ethoxylated alcohol has an alkyl radical with from 8 to 24 carbon atoms and from 1 to 30 ethoxy groups. A preferred detergent precursor is the ethoxylated alcohol with an alkyl chain length average varying between 12 and 16 and the average degree of ethoxylation of said mixture varying between 1 and 4 moles of ethylene oxide, said mixture comprising:

a. from about 0% to 10% by weight of said ethoxylated alcohol mixture of compounds containing 12 or 13 carbon atoms in the alkyl radical;
b. from about 50% to 100% by weight of said ethoxylated alcohol mixture of compounds containing 14 or 15 carbon atoms in the alkyl radical;
c. from about 0% to 45% by weight of said ethoxylated alcohol mixture of compounds containing 16 or 17 carbon atoms in the alkyl radical;
d. from about 0% to 10% by weight of said ethoxylated alcohol mixture of compounds containing 18 or 19 carbon atoms in the alkyl radical;
e. from about 0% to 30% by weight of said ethoxylated alcohol mixture of compounds having a degree of ethoxylation of zero;
f. from about 45% to 95% by weight of said ethoxylated alcohol mixture of compounds having a degree of ethoxylation of from 1 to 4;
g. from about 5% to 25% by weight of said ethoxylated alcohol mixture of compounds having a degree of ethoxylation of from 5 to 8; and
h. from about 0% to 15% by weight of said ethoxylated alcohol mixture of compounds having a degree of ethoxylation greater than 8.

α-olefins from 10 to 24 carbon atoms and fatty acids having from 8 to 20 carbon atoms and their esters with 1 to 14 carbon atoms in the alcohol radical are sulfonated using the viscosity aid of the present invention and the sulfonation techniques previously discussed to give low viscosity acid mixes. The acid mixes above, respectively, give upon sulfation α-olefin sulfonates, α-sulfocarboxylic acids, and esters thereof.

F. Viscosity Aid

The viscosity aid discovered by the patentees to reduce the viscosity of the acid mix composition is benzoic acid. Phthalic acid, isophthalic acid, and terephthalic acid were also found to lower acid mix viscosity; however, the low solubility of these compounds reduces their effectiveness.

The amount of benzoic acid used will depend upon the concentrations and amounts of the sulfating agent used and the type of material to be sulfated as well as the process utilized. While the invention requires an effective amount of the viscosity, it has generally been found that the weight ratio of sulfatable detrgent precursor to the benzoic acid is from about 100:1 to about 1:1, preferably from about 50:1 to about 3:2, and most preferably from about 40:1 to about 5:1.

The particular choice of the material to be sulfated will also determine to a certain extent the amount of viscosity aid required. In general as the alkyl chain length of an alkyl benzene increases or becomes more linear, a greater amount of viscosity aid will be required. Similarly, for fatty alcohols and ethoxylated alcohols a longer alkyl chain length increases viscosity as will a greater degree of ethoxylation.

The temperature of the given acid mix composition will, while increasing, generally require less viscosity aid. The importance of the proper utilization of the viscosity aid then is one which will allow the instant reaction to proceed at a lower temperature, thus minimizing charring and odor problems in the finished composition. The presence of inorganic acids in the mix tends to aggravate the viscosity problem, thereby requiring more of a given viscosity aid.

While the present invention primarily relates to reducing the viscosity of an acid mix composition comprising the viscosity aid and the sulfated organic material as well as any excess and unreacted detergent precursor, the benefits of reduced viscosity will also be appreciated in the crutcher mix following neutralization of the paste.

The following are examples of the applicants' invention.

EXAMPLE I 15.0 parts of an ethoxylated alcohol of the following description are mixed with 2.46 parts of benzoic acid. The ethoxylated alcohol mixture has an alkyl chain length average varying between 12 and 16 and the average degree of ethoxylation of said mixture varying between 1 and 4 moles of ethylene oxide, said mixture comprising:

a. from about 0% to 10% by weight of said ethoxylated alcohol mixture of compounds containing 12 or 13 carbon atoms in the alkyl radical;
b. from about 50% to 100% by weight of said ethoxylated alcohol mixture of compounds containing 14 or 15 carbon atoms in the alkyl radical;
c. from about 0% to 45% by weight of said ethoxylated alcohol mixture of compounds containing 16 or 17 carbon atoms in the alkyl radical;
d. from about 0% to 10% by weight of said ethoxylated alcohol mixture of compounds containing 18 or 19 carbon atoms in the alkyl radicals;
e. from about 0% to 30% by weight of said ethoxylated alcohol mixture of compounds having a degree of ethoxylation of zero;
f. from about 45% to 95% by weight of said ethoxylated alcohol mixture of compounds having a degree of ethoxylation of from 1 to 4;
g. from about 5% to 25% by weight of said ethoxylated alcohol mixture of compounds having a degree of ethoxylation of from 5 to 8;
h. from about 0% to 15% by weight of said ethoxylated alcohol mixture of compounds having a degree of ethoxylation greater than 8.

The ethoxylated alcohol and benzoic acid are then sulfated with 7.0 parts of 30% oleum. The viscosity of the sulfated mixture is observed to be 336 cps at 120°F as measured by a Brookfield Model LVT Viscometer using a number 2 spindle. In the absence of benzoic acid the viscosity is approximately 1200 cps.

EXAMPLE II 13.27 parts of a triethoxylated tallow alcohol are mixed with 6.77 parts of benzoic acid. The mixture is then sulfated with 7.6 parts of 30% oleum. The viscosity is measured as in Example I at 170°F and found to be 233 cps. In the absence of benzoic acid, the mixture was too viscous to be measured at 180°F.

EXAMPLE III 12.66 parts of middle cut coconut triethoxylated alcohol are mixed with 1.2 parts of benzoic acid. The mixture is then sulfated with 8.98 parts of 30% oleum. The resultant viscosity of the acid mix is 370 cps at 118°F. A similar composition without benzoic acid had a viscosity of 582 cps at 120°F. Both measurements were made using the equipment specified in Example I.

EXAMPLE IV 12.0 parts of tallow alcohol are mixed with 5.0 parts of benzoic acid. The mixture is then sulfated with 5.0 parts of chlorosulfonic acid to give a low viscosity acid mix. This example is repeated using equal parts of the alcohol and benzoic acid to give a low viscosity acid mix.

EXAMPLE V 14.0 parts of tallow alcohol are mixed with 0.7 parts of benzoic acid. The resultant mixture is then sulfated with 4 parts 100% $SO_3$ to give a low viscosity acid mix.

EXAMPLE VI 15.0 parts of middle cut coconut triethoxylated alcohol are mixed with 0.5 parts of benzoic acid. The mixture is then sulfated with 26.3 parts of 5% oleum at a recirculation of 25:1 at 120°F to give a low viscosity acid mix.

EXAMPLE VII 20.0 parts of $C_{12}$ alkyl benzene are mixed with 3.0 parts of benzoic acid. The mixture is then sulfated with 8.7 parts 65% oleum to give a low viscosity acid mix.

EXAMPLE VIII 100 parts of a tallow triethoxylated alcohol are mixed with 7 parts of benzoic acid. The mixture is then sulfated with 20 parts of 100% $SO_3$ in a falling film reactor. The viscosity of the acid mix is measured as in Example I and found to be 174 cps at 121°F. Without benzoic acid the viscosity at 120°F is 498 cps. Similar results are obtained when 100 parts of the ethoxylated alcohol are sulfated in the presence of 1 part of benzoic acid.

The following compositions are prepared in accordance with Tables I and II which exhibit low acid mix viscosity. The respective acid mixes comprise an organic sulfuric or sulfonic acid and benzoic acid as a viscosity aid. Some unreacted detergent precursor and inorganic acid may be present in the acid mix.

TABLE I

| DETERGENT PRECURSOR | PARTS DETERGENT PRECURSOR | PARTS BENZOIC ACID | PARTS 30% ACID STRENGTH OLEUM | PARTS 100% $H_2SO_4$ | PARTS 100% $SO_3$ |
|---|---|---|---|---|---|
| $C_{15}$ alkyl triethoxy alcohol | 12 | 2 | — | 15 | — |
| $C_{14}$ α-olefin | 15 | 2 | — | — | 4 |
| $C_{11.8}$ LAS | 10 | 2 | 10 | — | — |

TABLE II

| DETERGENT PRECURSOR | PARTS DETERGENT PRECURSOR | PARTS BENZOIC ACID | PARTS 100% CHLORO-SULFONIC ACID | PARTS 100% $SO_3$ |
|---|---|---|---|---|
| Tallow alcohol Coconut triethoxy | 10 | 3 | — | 4 |

TABLE II-continued

| DETERGENT PRECURSOR | PARTS DETERGENT PRECURSOR | PARTS BENZOIC ACID | PARTS 100% CHLORO-SULFONIC ACID | PARTS 100% $SO_3$ |
|---|---|---|---|---|
| alcohol | 15 | 1 | 3.3 | — |
| Tallow triethoxy alcohol | 20 | 0.5 | — | 4 |

The instant compositions disclosed in the examples are neutralized to form a detergent paste and further processed in a crutcher wherein detergency builders and other ingredients are added to give a slurry which is spray-dried into a granular detergent composition. Alternatively, the acid mix may be used as a base for liquid detergent compositions.

The granular detergents formulated in the instant invention are dissolved in an aqueous laundering or washing solution at from 0.01 to 0.2% by weight. Preferably such compositions are utilized in water to the extent of from about 0.06% to about 0.18% by weight. This preferred concentration is approximated when about 0.5 to 1.5 cups of the instant composition are added to 17 to 23 gallons of water in a commercialy available washing machine. Dependent on the choice of a detergency builder, the washing solution pH will vary but is preferably held between 9.5 and 10.5. Soiled fabrics or other articles are added to the laundering liquor and cleansed in the usual manner.

What is claimed is:

1. In the process of sulfating an organic detergent precursor the steps including contacting the detergent precursor with a sulfating agent, the improvement thereon comprising carrying out the reaction in the presence of an effective amount of benzoic acid to lower the acid mix viscosity.

2. The process of claim 1 wherein the weight ratio of detergent precursor to the benzoic acid is from about 100:1 to about 1:1.

3. The process of claim 2 wherein the detergent precursor is selected from the group consisting of alkyl benzenes, ethoxylated alcohols, fatty alcohols, $\alpha$-olefins, aliphatic carboxylic acids, the esters of aliphatic carboxylic acids and mixtures thereof.

4. The process of claim 3 wherein the weight ratio of detergent precursor to the benzoic acid is from about 50:1 to about 3:2.

5. The process of claim 4 wherein the ethoxylated alcohol has from 8 to 24 carbon atoms in the alkyl radical and the degree of ethoxylation is from 1 to 30.

6. A process in accordance with claim 5 wherein the ethoxylated alcohol has an alkyl chain length average varying between 12 and 16, and the average degree of ethoxylation of said mixture varying between 1 and 4 moles of ethylene oxide, said mixture comprising:

a. from about 0% to 10% by weight of said ethoxylated alcohol mixture of compounds containing 12 or 13 carbon atoms in the alkyl radical;

b. from about 50% to 100% by weight of said ethoxylated alcohol mixture of compounds containing 14 or 15 carbon atoms in the alkyl radical;

c. from about 0% to 45% by weight of said ethoxylated alcohol mixture of compounds containing 16 or 17 carbon atoms in the alkyl radical;

d. from about 0% to 10% by weight of said ethoxylated alcohol mixture of compounds containing 18 or 19 carbon atoms in the alkyl radical;

e. from about 0% to 30% by weight of said ethoxylated alcohol mixture of compounds having a degree of ethoxylation of zero;

f. from about 45% to 95% by weight of said ethoxylated alcohol mixture of compounds having a degree of ethoxylation of from 1 to 4;

g. from about 5% to 25% by weight of said ethoxylated alcohol mixture of compounds having a degree of ethoxylation of from 5 to 8; and h. having about 0% to 15% by weight of said ethoxylated alcohol mixture of compounds having a degree of ethoxylation greater than 8.

7. The process of claim 4 wherein the alkyl benzene has from 9 to 15 carbon atoms in the alkyl radical.

8. The process of claim 7 wherein the mean alkyl chain length is between 11 and 12.

9. The process of claim 4 wherein the fatty alcohol contains from 8 to 24 carbon atoms in the alkyl radical.

10. The process of claim 4 wherein the detergent precursor is an $\alpha$-olefin having from 10 to 24 carbon atoms in the alkyl radical.

11. The process of claim 4 wherein the aliphatic carboxylic acid has from 8 to 20 carbon atoms in the alkyl radical.

12. The process of claim 4 wherein the ester of the aliphatic carboxylic acid has from 8 to 20 carbon atoms in the acid radical and from 1 to 14 carbon atoms in the alcohol radical.

13. The process of claim 1 wherein the sulfating agent is sulfur trioxide.

14. The process of claim 1 wherein the sulfating agent is chlorosulfonic acid.

15. The process of claim 1 wherein the sulfating agent is oleum.

* * * * *